US009937545B1

(12) United States Patent
Van Zweden

(10) Patent No.: US 9,937,545 B1
(45) Date of Patent: Apr. 10, 2018

(54) MANDREL SUPPORT DEVICE FOR TUBE BENDING MACHINE

(71) Applicant: Nathan Van Zweden, Hull, IA (US)

(72) Inventor: Nathan Van Zweden, Hull, IA (US)

(73) Assignee: Kooima Company, Rock Valley, IA (US)

( * ) Notice: Subject to any disclaimer, the term of this patent is extended or adjusted under 35 U.S.C. 154(b) by 0 days.

(21) Appl. No.: 15/596,088

(22) Filed: May 16, 2017

(51) Int. Cl.
*B21D 9/16* (2006.01)
*B21D 9/01* (2006.01)
*B21D 39/08* (2006.01)

(52) U.S. Cl.
CPC ..... *B21D 9/16* (2013.01); *B21D 9/01* (2013.01); *B21D 39/08* (2013.01)

(58) Field of Classification Search
CPC ..... B21D 9/01; B21D 9/16; B21D 39/08
USPC ..... 72/466.2
See application file for complete search history.

(56) References Cited

U.S. PATENT DOCUMENTS 2,930,265 A * 3/1960 Fuchs, Jr. ..... B21C 9/00 72/39
3,779,064 A * 12/1973 Besson ..... B21C 37/30 72/283
3,813,272 A 5/1974 Straughan
4,063,439 A * 12/1977 Besson ..... B21C 1/24 72/283
4,118,964 A * 10/1978 Fusco ..... B21C 37/207 72/208
4,378,689 A 4/1983 Molz
4,380,917 A 4/1983 Uchida
4,493,203 A 1/1985 Wheeler
4,538,436 A 9/1985 Schwarze
4,744,233 A 5/1988 Trudell
4,759,206 A 7/1988 Kaneko
4,959,984 A 10/1990 Trudell
5,301,530 A 4/1994 Beelen
5,345,802 A 9/1994 Caporusso
5,564,303 A 10/1996 Buchanan
8,117,883 B2 * 2/2012 Simpson ..... E21B 43/105 166/384

(Continued)

OTHER PUBLICATIONS

Unison TJP Electronics, LTD., "Assembly—Mandrel Front Unit", drawing, Jul. 1, 2012, one sheet, North Yorkshire, UK.

*Primary Examiner* — David B Jones
(74) *Attorney, Agent, or Firm* — Jeffrey A. Proehl; Woods Fuller Shultz & Smith, P.C

(57) ABSTRACT

A mandrel support device includes a mandrel sleeve positionable on a mandrel to form a reservoir in fluid communication with a mandrel passage, and with. The sleeve may include a bore configured to receive a portion of the mandrel, a lubrication channel formed on the sleeve exterior, and a lubrication passage extending between the channel and the bore to permit fluid communication therebetween. A mandrel base may define a socket for interchangeably receiving the sleeve, and a lubrication bore may extend from the socket to the base to align with the lubrication channel when the sleeve is received in the socket. A fluid fitting mounted on the base in fluid communication with the lubrication bore and the lubrication channel of the sleeve such that fluid moving through the fluid fitting enters the bore, the channel and passage to reach the reservoir and mandrel passage at any rotational position of the sleeve with respect to the base.

16 Claims, 8 Drawing Sheets

(56) References Cited

U.S. PATENT DOCUMENTS 9,156,075 B2 10/2015 Houle

* cited by examiner

MANDREL SUPPORT DEVICE FOR TUBE BENDING MACHINE

BACKGROUND

Field

The present disclosure relates to tube bending machines and more particularly pertains to a new mandrel support device for tube bending machine for simplifying the supply of lubrication fluid to the mandrel.

SUMMARY

The present disclosure relates to a mandrel support device configured to move a portion of a mandrel in a tube on a tube bending machine, with the mandrel having a passage for lubricating fluid. The mandrel support device may comprise a mandrel sleeve positionable on a base portion of the mandrel and configured to form a reservoir between the mandrel sleeve and a base end of the mandrel, and the reservoir may be in fluid communication with the passage in the mandrel when the mandrel is inserted into the mandrel sleeve. The sleeve has a front end, a rear end and a sleeve exterior extending between the front and rear end. The mandrel sleeve may include a bore configured to receive the base portion of the mandrel, with the bore extending from the front end toward the rear end and being closed at the rear end. The mandrel sleeve having an annular retainer groove formed on the sleeve exterior of the mandrel sleeve, an annular lubrication channel formed on the sleeve exterior of the mandrel sleeve, and at least one lubrication passage extending between the lubrication channel and the bore to permit fluid communication between the bore and the lubrication channel. The mandrel support device may also include a mandrel base defining a socket for interchangeably receiving at least a portion of the mandrel sleeve, with the mandrel base having a base exterior. The mandrel base may include a lubrication bore extending from the socket to the base exterior of the mandrel base, with the lubrication bore being configured to align with the lubrication channel of the mandrel sleeve when the mandrel sleeve is received in the socket. The mandrel support device may also include a fluid fitting mounted on the mandrel base, and a retainer configured to engage the retainer groove of the mandrel sleeve and releasably retain the mandrel sleeve in the mandrel base in a manner permitting the mandrel sleeve to rotate with respect to the mandrel base when the mandrel sleeve is retained on the mandrel base by the retainer. The fluid fitting may be in fluid communication with the lubrication bore and the lubrication channel of the mandrel sleeve such that fluid moving through the fluid fitting enters the lubrication bore, the lubrication channel and the lubrication passage to reach the reservoir and the passage of the mandrel at any rotational position of the mandrel sleeve with respect to the mandrel base.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of any steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
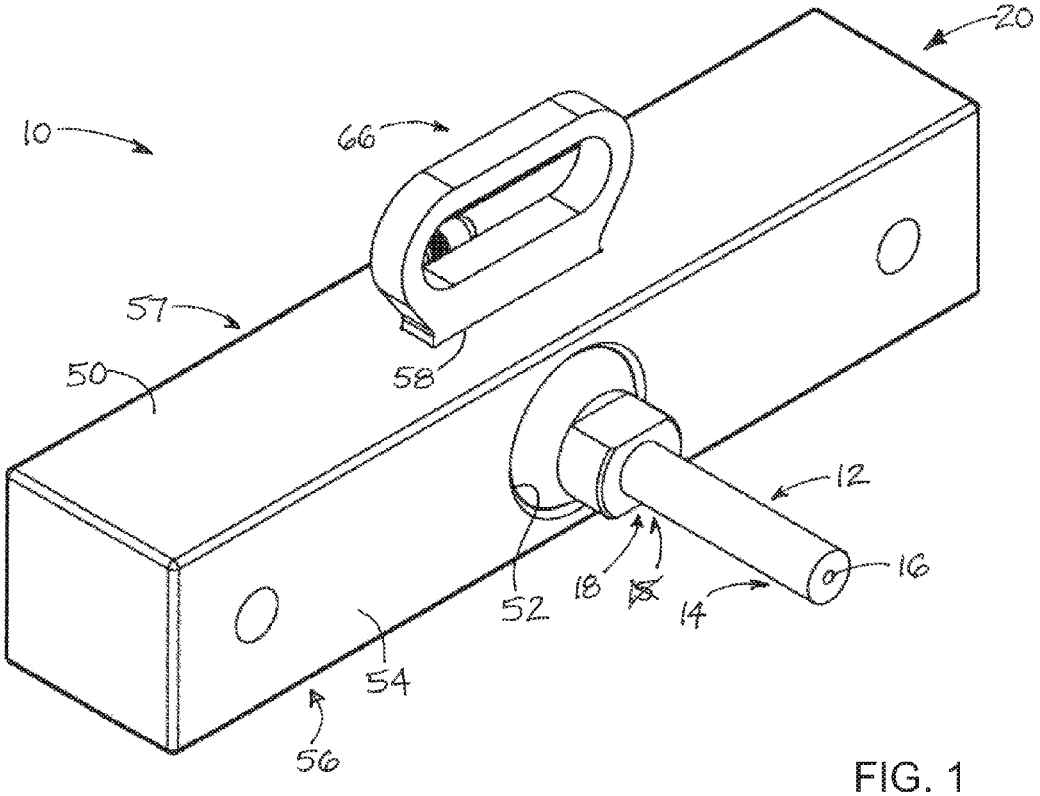
FIG. 1 is a schematic front perspective view of a new mandrel support device for tube bending machine according to the present disclosure.
Figure 2:
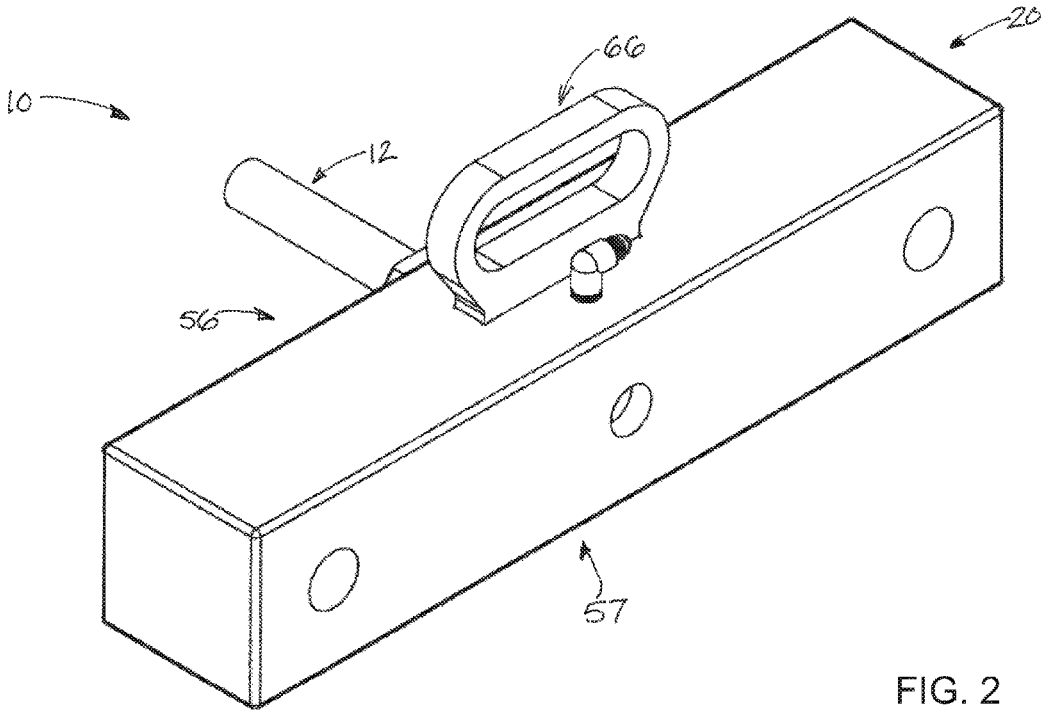
FIG. 2 is a schematic rear perspective view of the mandrel support device, according to an illustrative embodiment.
Figure 3:
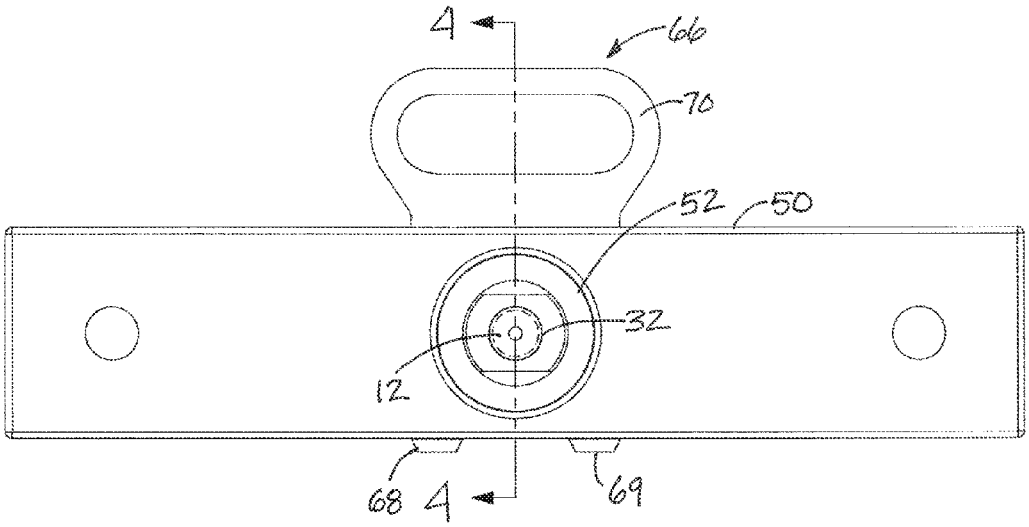
FIG. 3 is a schematic front view of the mandrel support device, according to an illustrative embodiment.
Figure 4:
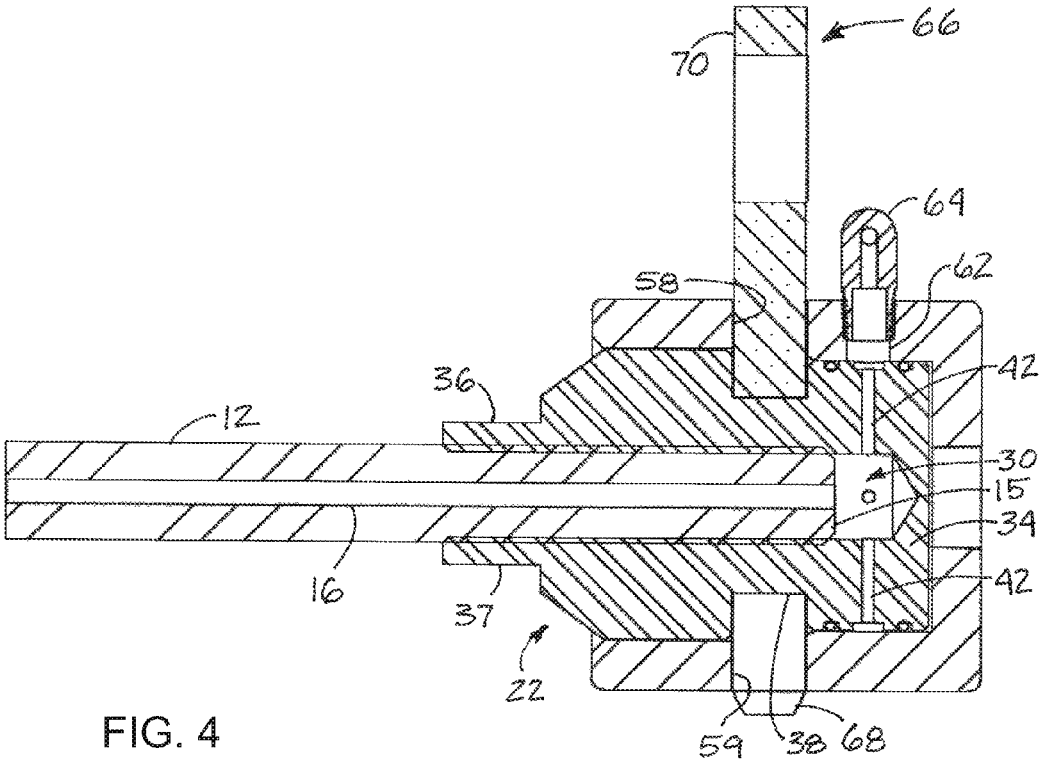
FIG. 4 is a schematic side sectional view of the mandrel support device taken along line 4-4 of FIG. 3, according to an illustrative embodiment.
Figure 5:
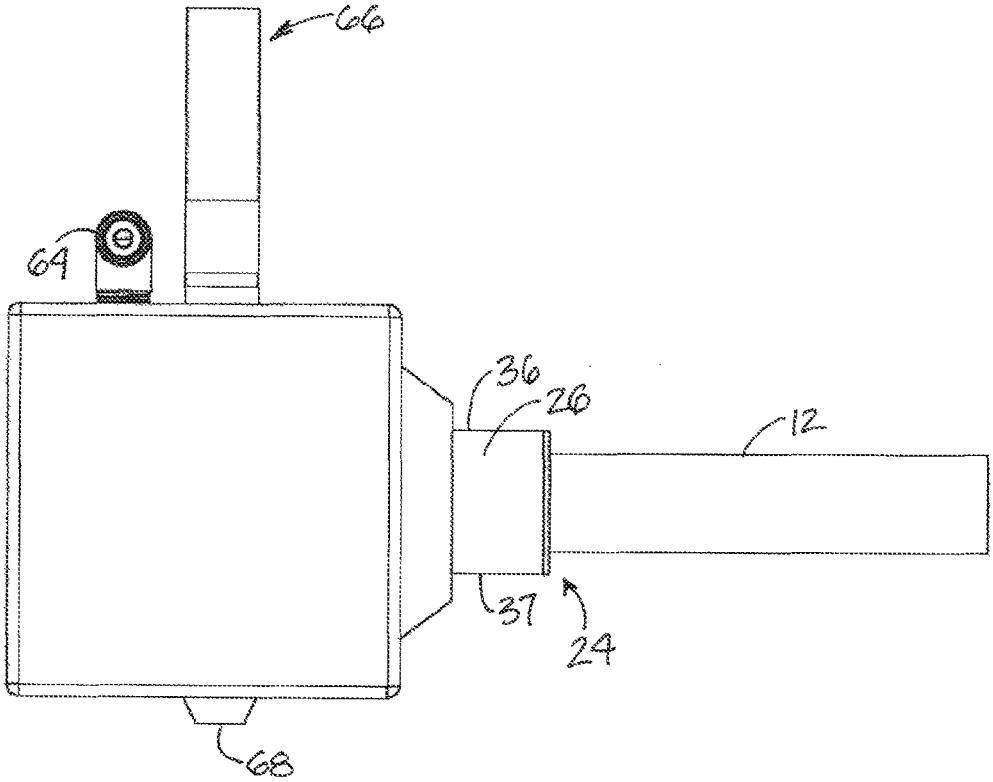
FIG. 5 is a schematic side view of the mandrel support device, according to an illustrative embodiment.
Figure 6:
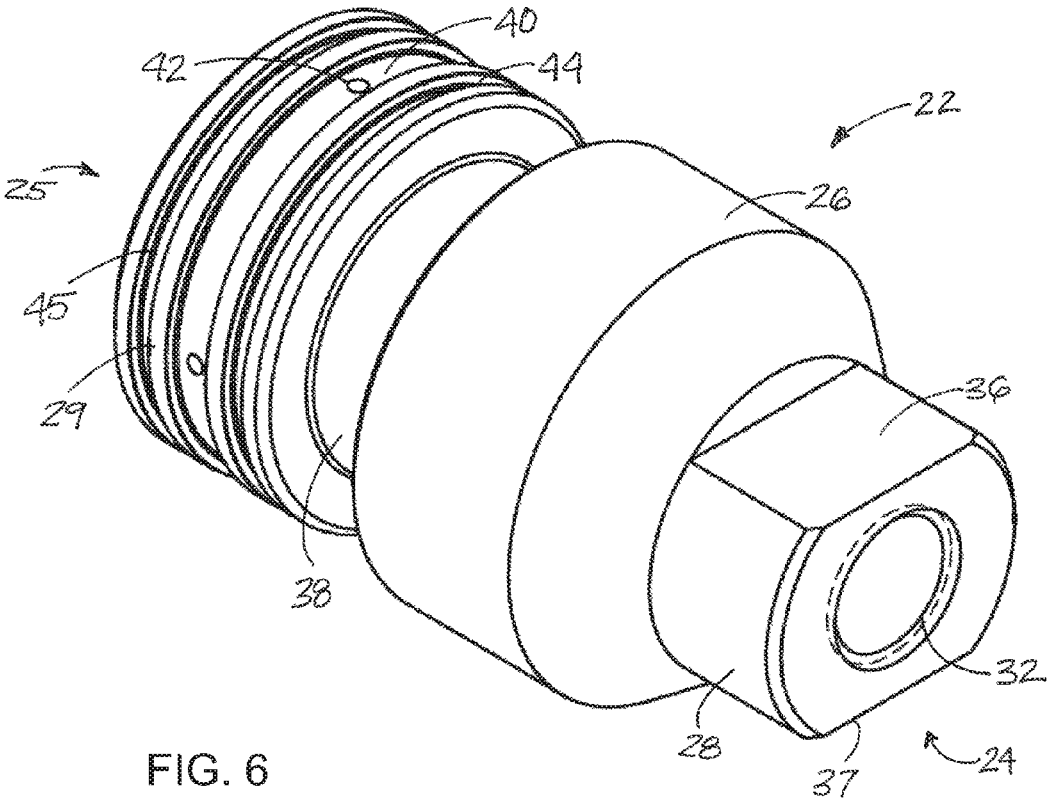
FIG. 6 is a schematic perspective view of an embodiment of the mandrel sleeve of the mandrel support device, according to an illustrative embodiment.
Figure 7:
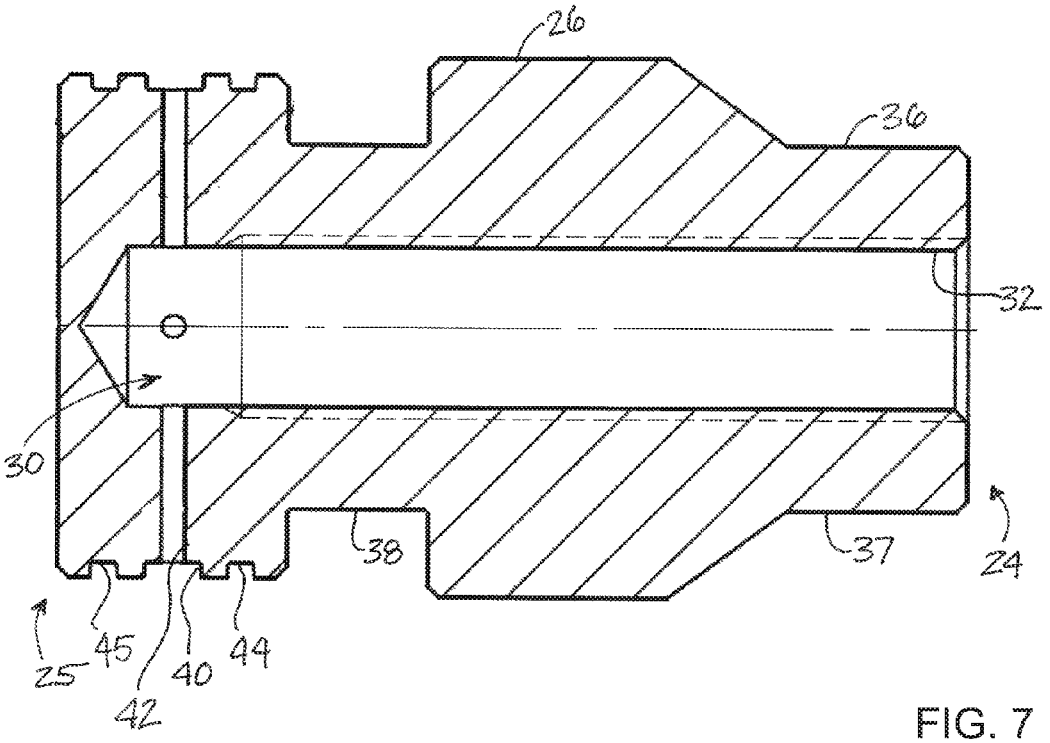
FIG. 7 is a schematic side sectional view of the embodiment of the mandrel sleeve of the mandrel support device shown in FIG. 6, according to an illustrative embodiment.
Figure 8:
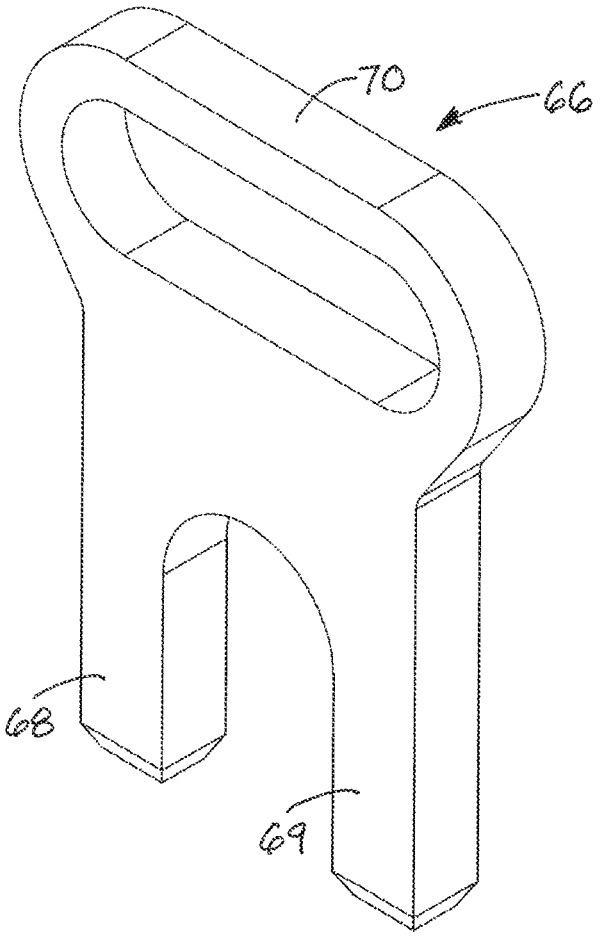
FIG. 8 is a schematic perspective view of an embodiment of the retainer device of the mandrel support device, according to an illustrative embodiment.

With reference now to the drawings, and in particular to FIGS. 1 through 8 thereof, a new mandrel support device for tube bending machine embodying the principles and concepts of the disclosed subject matter will be described.

Machines for bending tubes such as pipes are known, and typically employ an elongated mandrel which is inserted into the tube prior to bending and remains in the tube while the tube is being bent in order to help preserve the cross-sectional shape, such as round or circular, of the tube while the tube is being bent, which would otherwise tend to fold and at least partially collapse thereby significantly decreasing the cross-sectional area of the tube. Lubricating fluid may be introduced into the tube via a passage extending through the mandrel which is then dispersed at locations on the mandrel that are inserted into the tube, and which reduces friction between the outer surface of the mandrel and the inner surface of the tube while the tube is being bent.

The applicants have recognized that conventional approaches to introducing the lubricating fluid into the mandrel are unnecessarily complicated and difficult to use in that the approaches typically have a fluid fitting mounted directly on the mandrel and thus require disconnection and reconnection of a fluid carrying conduit to a different fitting on a different mandrel every time the mandrel of different character (e.g., diameter size) is utilized for a different size of tube to be bent. The slippery character of the lubrication fluid only makes the connection and disconnection process more difficult.

In one aspect, the disclosure relates to a system 10 for bending a tube which is typically substantially hollow with an interior and at least one open end which extends into the tube interior. An elongated mandrel 12 which is configured to insert into the tube to be bent may have an insertion end 14 for insertion into the tube interior, and the base and 15 which generally remains outside of the tube interior when the insertion end is inserted into the tube. The mandrel 12 may have a passage 16 which is configured to carry a lubricating fluid, and may extend along at least a portion of the mandrel such as from the base and 15 toward the insertion end 14 of the mandrel. A base portion 18 of the mandrel may be located toward the base end and may be generally rigid in character, while an insertion portion located toward the insertion end 14 may be flexible to permit the mandrel to be bent along with the tube being bent by the bending machine. For example, the insertion portion may comprise a plurality of loosely connected discs which facilitate the bending of the insertion portion of the mandrel.

Another aspect of the disclosure relates to a mandrel support device 20, which may be used in combination with the mandrel 12 as well as the bending machine. The mandrel support device 20 may be used to push a portion of the mandrel into the interior of the tube as well as withdraw the mandrel from the tube after the bending operation has been performed. Generally, the mandrel support device is movable in a substantially horizontal plane by a movable ram of the bending machine.

The mandrel support device 20 may comprise a mandrel sleeve 22 which is positionable on the base portion of the mandrel adjacent to the base end 15. The mandrel sleeve may have a front end 24 and a rear end 25, and may have a sleeve exterior 26 that extends between the front 24 and rear 25 ends. The sleeve exterior 26 may have a front portion 28 located toward the front end 24 and a rear portion 29 which is located toward the rear end 25. The mandrel sleeve 22 may be configured to form a reservoir 30 between the mandrel sleeve and the base end 15 of the mandrel. The reservoir 30 may be in fluid communication with the passage 16 in the mandrel when the mandrel is inserted into the mandrel sleeve.

The mandrel sleeve 22 may include a bore 32 for receiving the base portion 18 of the mandrel. Once inserted into the mandrel sleeve, the mandrel may be fastened or fixed to the sleeve in any suitable manner, and may be fastened in a manner that resists or prevents rotation of the mandrel 12 with respect to the mandrel sleeve 22. The bore 32 may extend between the front end 24 and the rear end 25, and may extend from the front end toward the rear end. The bore 32 may be closed at the rear end by a rear wall portion 34. The bore 32 may also be configured to limit the degree of insertion of the base portion of the mandrel into the bore such that a space forming the reservoir 30 is maintained in the bore between the rear end 25 of the mandrel and rear wall portion 34.

The mandrel sleeve 22 may also include a pair of flats 36, 37 formed on opposite sides of the front portion of the exterior of the sleeve to facilitate gripping of the sleeve by, for example, a wrench. The mandrel sleeve 22 may further include an annular retainer groove 38 which may be formed on the rear portion of the sleeve exterior of the mandrel sleeve. An annular lubrication channel 40 may be formed on the rear portion of the sleeve exterior of the mandrel sleeve. At least one lubrication passage 42 may extend between the lubrication channel 40 and the bore 32 to permit fluid communication between the channel 40 and the bore 32. In some embodiments, multiple passages 42 may be formed in the mandrel sleeve 22 at substantially equal angular separations and circumferential spacings. A pair of annular seal grooves 44, 45 may be formed on the rear portion of the sleeve exterior of the mandrel sleeve, and one of the seal grooves 44 may be located adjacent to the lubrication channel and between the lubrication channel and the front end of the mandrel sleeve, while another one of the seal grooves 45 may be located adjacent to the lubrication channel and between the lubrication channel and the rear end of the mandrel sleeve. An O-ring seal may be positioned in each of the seal grooves 44, 45 to create a seal on each side of the lubrication channel 40.

The mandrel support device 20 may further include a mandrel base 50 which defines a socket 52 for interchangeably receiving at least a portion of the mandrel sleeve 22 mounted on a mandrel 12. The mandrel base 50 may have a base exterior 54 with a front 56 and a rear 57. An opening may be located on the front of the mandrel base 50 and may extend into the socket 52. The socket 52 may extend from the opening toward the rear 57 of the base 50. The socket 52 may be at least partially closed at the rear of the mandrel base to limit or define the degree of full insertion of the mandrel sleeve 22 into the socket. The mandrel base 50 may include an upper slot 58 which may extend from the base exterior 54 to the socket 52, and a lower slot 60 which may extend from the base exterior 54 to the socket in at least partial alignment with the upper slot but in general opposition to the upper slot on an opposite side of the socket.

The mandrel base 50 may also include a lubrication bore 62 which extends from the socket 52 to the base exterior 54 of the base 50. The lubrication bore may be configured to align with the lubrication channel 40 of the mandrel sleeve when the mandrel sleeve is suitably inserted into the socket. A fluid fitting 64 may be mounted on the mandrel base and may be in fluid communication with the lubrication bore 62 to permit introduction of the lubricating fluid into the mandrel base 50. Introduction of a lubrication fluid through the fluid fitting and into the lubrication bore allows the lubricating fluid to reach the lubrication channel 40 and the lubrication passage 42 of the mandrel sleeve to thereby reach the reservoir 30 and the passage 16 of the mandrel at any rotational position of the mandrel sleeve with respect to the mandrel base. The circumferential character of the lubrication channel 40 allows the lubrication fluid to reach the lubrication passage 42 from the lubrication bore at any rotational position of the mandrel sleeve in the mandrel base.

A retainer 66 may be configured to releasably retain the mandrel sleeve in the mandrel base to permit interchangeable mounting and dismounting of the mandrel sleeve on the mandrel base. The retainer 66 may be insertable into the mandrel base, such as into the upper slot 58, to engage the annular retainer groove 38 in the mandrel sleeve when the sleeve is suitably inserted into the socket while still permitting the mandrel sleeve to rotate with respect to the mandrel base. The retainer 66 may also extend into the lower slot 62 and enhance the retaining effect of the retainer 66 on the mandrel sleeve. In some embodiments, the retainer 66 may include a pair of arms 68, 69 which extend in a spaced and substantially parallel relationship to move along opposite sides of the upper slot and on opposite sides of the mandrel sleeve to engage opposite locations of the retainer groove 38. A handle 70 may extend from the pair of arms 68, 69 in a location exterior of the retainer base to facilitate hand gripping of the retainer to remove and replace the retainer on the mandrel base.

In use, a mandrel sleeve 22 may be mounted on the base portion 18 of the mandrel 12, and different mandrel sleeves with suitably-sized bores 32 may be mounted on each of a number of mandrels with different outer diameter sizes such that a variety of mandrel and mandrel sleeve assemblies may be interchangeably mounted on the mandrel base based upon, for example, the inside diameter of the tube to be bent by the bending machine. Once a suitable mandrel and mandrel sleeve assembly is selected for the tube to be bent, the mandrel sleeve may be inserted into the socket 52 of the mandrel base and the arms 68, 69 of the retainer 66 may be inserted into the upper slot of the mandrel base to engage the retainer groove 38 on the mandrel sleeve to thereby prevent removal of the mandrel sleeve and mandrel from the socket of the mandrel base until the retainer is removed from the base. Rotation of the mandrel and mandrel sleeve with respect to the mandrel base is not restricted by the retainer as the arms 68, 69 are free to move along the circumference of the mandrel sleeve in the retainer groove 38. Lubricating fluid may be supplied to the fluid fitting 64 and the fluid is able to pass through the mandrel base and the mandrel sleeve to reach the passage in the mandrel to facilitate the bending operation as well as removal of the mandrel after the bending operation is complete. Upon completion of the bending operation, the mandrel sleeve and mandrel assembly may be removed from the mandrel base by removal of the retainer 66 from the upper slot which serves to disengage the mandrel sleeve from the base and permit its removal from the socket. Significantly, the fluid fitting and conduit remains connected to the mandrel base regardless of the mandrel and mandrel sleeve utilized in the bending operation.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A mandrel support device configured to move a portion of a mandrel in a tube on a tube bending machine, the mandrel having a passage for lubricating fluid, the mandrel support device comprising:

a mandrel sleeve positionable on a base portion of the mandrel and configured to form a reservoir between the mandrel sleeve and a base end of the mandrel, the reservoir being in fluid communication with the passage in the mandrel when the mandrel is inserted into the mandrel sleeve, the sleeve having a front end, a rear end and a sleeve exterior extending between the front and rear end, the mandrel sleeve including:

a bore configured to receive the base portion of the mandrel, the bore extending from the front end toward the rear end and being closed at the rear end;

an annular retainer groove formed on the sleeve exterior of the mandrel sleeve;

an annular lubrication channel formed on the sleeve exterior of the mandrel sleeve;

at least one lubrication passage extending between the lubrication channel and the bore to permit fluid communication between the bore and the lubrication channel;

a mandrel base defining a socket for interchangeably receiving at least a portion of the mandrel sleeve, the mandrel base having a base exterior, the mandrel base including:

a lubrication bore extending from the socket to the base exterior of the mandrel base, the lubrication bore being configured to align with the lubrication channel of the mandrel sleeve when the mandrel sleeve is received in the socket;

a fluid fitting mounted on the mandrel base;

a retainer configured to engage the retainer groove of the mandrel sleeve and releasably retain the mandrel sleeve in the mandrel base in a manner permitting the mandrel sleeve to rotate with respect to the mandrel base when the mandrel sleeve is retained on the mandrel base by the retainer; and wherein the fluid fitting is in fluid communication with the lubrication bore and the lubrication channel of the mandrel sleeve such that fluid moving through the fluid fitting enters the lubrication bore, the lubrication channel and the lubrication passage to reach the reservoir and the passage of the mandrel at any rotational position of the mandrel sleeve with respect to the mandrel base.

2. The device of claim 1 wherein the sleeve exterior having a front portion toward the front end and a rear portion toward the rear end, the retainer groove and the lubrication channel being located on the rear portion.

3. The device of claim 1 wherein the bore in the mandrel sleeve is configured to limit insertion of the base portion of the mandrel into the bore such that the reservoir is formed between the base end of the mandrel and a rear wall portion of the mandrel sleeve.

4. The device of claim 1 wherein the mandrel sleeve includes a pair of annular seal grooves on the rear portion of the sleeve exterior of the mandrel sleeve, each of the seal grooves of the pair of seal grooves being located on opposite side of the lubrication channel.

5. The device of claim 4 wherein an O-ring seal is positioned in each of the seal grooves.

6. The device of claim 1 wherein the mandrel sleeve includes a pair of flats on opposite sides of the sleeve exterior of the sleeve.

7. The device of claim 1 wherein an upper slot is formed in the mandrel base, the retainer being insertable into the upper slot in the mandrel base to engage the annular retainer groove in the mandrel sleeve when the sleeve is inserted into the socket.

8. The device of claim 7 wherein the retainer has a pair of arms in a spaced and substantially parallel relationship to engage opposite locations on the retainer groove.

9. The device of claim 8 wherein the retainer has a handle extending from the pair of arms and being located exterior of the mandrel base when the retainer is inserted into the upper slot.

10. The device of claim 1 wherein a lower slot is formed in the mandrel base, the lower slot being at least partially in alignment with the upper slot such that the retainer is insertable into the lower slot when inserted into the upper slot.

11. A system for bending a tube, the tube having an interior and an open end into the interior, the system comprising:

an elongated mandrel configured to insert into a tube to be bent, the mandrel having an insertion end for insertion into the tube and a base end remaining outside of the tube when the insertion end is inserted into the tube, the mandrel having a base portion adjacent to the base end, the mandrel having a passage configured to carry a fluid along at least a portion of the mandrel, the passage extending from the base end toward the insertion end of the mandrel;

a mandrel support device comprising:

a mandrel sleeve positioned on the base portion of the mandrel and forming a reservoir between the mandrel sleeve and a base end of the mandrel, the reservoir being in fluid communication with the passage in the mandrel, the sleeve having a front end, a rear end and a sleeve exterior extending between the front and rear end, the mandrel sleeve including:

a bore configured to receive the base portion of the mandrel, the bore extending from the front end toward the rear end and being closed at the rear end;

an annular retainer groove formed on the sleeve exterior of the mandrel sleeve;

an annular lubrication channel formed on the sleeve exterior of the mandrel sleeve;

at least one lubrication passage extending between the lubrication channel and the bore to permit fluid communication between the bore and the lubrication channel;

a mandrel base defining a socket interchangeably receiving at least a portion of the mandrel sleeve, the mandrel base having a base exterior, the mandrel base including:

a lubrication bore extending from the socket to the base exterior of the mandrel base, the lubrication bore being configured to align with the lubrication channel of the mandrel sleeve when the mandrel sleeve is received in the socket;

a fluid fitting mounted on the mandrel base;

a retainer engaging the retainer groove of the mandrel sleeve and releasably retaining the mandrel sleeve in the mandrel base in a manner permitting the mandrel sleeve to rotate with respect to the mandrel base when the mandrel sleeve is retained on the mandrel base by the retainer; and wherein the fluid fitting is in fluid communication with the lubrication bore and the lubrication channel of the mandrel sleeve such that fluid moving through the fluid fitting enters the lubrication bore, the lubrication channel and the lubrication passage to reach the reservoir and the passage of the mandrel at any rotational position of the mandrel sleeve with respect to the mandrel base.

12. The system of claim 11 wherein the bore in the mandrel sleeve is configured to limit insertion of the base portion of the mandrel into the bore such that the reservoir is formed between the base end of the mandrel and a rear wall portion of the mandrel sleeve.

13. The system of claim 11 wherein the mandrel sleeve includes a pair of annular seal grooves on the rear portion of the sleeve exterior of the mandrel sleeve, each of the seal grooves of the pair of seal grooves being located on opposite side of the lubrication channel.

14. The system of claim 13 wherein an O-ring seal is positioned in each of the seal grooves.

15. The system of claim 11 wherein an upper slot is formed in the mandrel base, the retainer being insertable into the upper slot in the mandrel base to engage the annular retainer groove in the mandrel sleeve when the sleeve is inserted into the socket.

16. The system of claim 15 wherein the retainer has a pair of arms in a spaced and substantially parallel relationship to engage opposite locations on the retainer groove.

* * * * *